US007281302B2

(12) United States Patent
Hewes

(10) Patent No.: US 7,281,302 B2
(45) Date of Patent: Oct. 16, 2007

(54) CABLE TIE

(75) Inventor: David A. Hewes, Chesterfield, MA (US)

(73) Assignee: Advanced Cable Ties, Inc., Gardner, MA (US)

( * ) Notice: Subject to any disclaimer, the term of this patent is extended or adjusted under 35 U.S.C. 154(b) by 98 days.

(21) Appl. No.: 11/083,047

(22) Filed: Mar. 17, 2005

(65) Prior Publication Data

US 2005/0204515 A1 Sep. 22, 2005

Related U.S. Application Data

(60) Provisional application No. 60/554,108, filed on Mar. 18, 2004.

(51) Int. Cl.
*B65D 63/00* (2006.01)

(52) U.S. Cl. ..... 24/16 PB

(58) Field of Classification Search ..... 24/16 R, 24/16 PB, 17 A, 17 AP, 30.5 P; 248/74.3; 292/307 A, 318, 322, 325, 321, 319, 323, 292/307 R; 24/20 TT
See application file for complete search history.

(56) References Cited

U.S. PATENT DOCUMENTS 4,021,888 A * 5/1977 Aimar ..... 24/16 PB
5,193,250 A * 3/1993 Caveney ..... 24/16 PB
5,881,435 A * 3/1999 Jermyn, Jr. ..... 24/16 PB
5,901,416 A * 5/1999 Mears ..... 24/16 PB

FOREIGN PATENT DOCUMENTS

EP 398562 A * 11/1990

* cited by examiner

*Primary Examiner*—James R Brittain
(74) *Attorney, Agent, or Firm*—Brian M. Dingman; Mirick, O'Connell, DeMallie & Lougee

(57) ABSTRACT

A cable tie having an elongated tongue with two ends and two broad sides, a tip at one end of the tongue, a set of ratchet teeth extending along at least one broad side of the tongue, and a locking head at the other end of the tongue. The locking head has sides defining an opening for receiving the tip of the tongue, and a movable pawl that is hinged at one side of the opening, with another side of the locking head defining an abutment wall that is across the opening from the pawl. The pawl engages with one or more of the ratchet teeth when the tongue has been inserted through the opening with the set of ratchet teeth facing the pawl. At least one other side of the locking head defines a thinned region that can be torn by the user to release the tongue from the head.

6 Claims, 6 Drawing Sheets

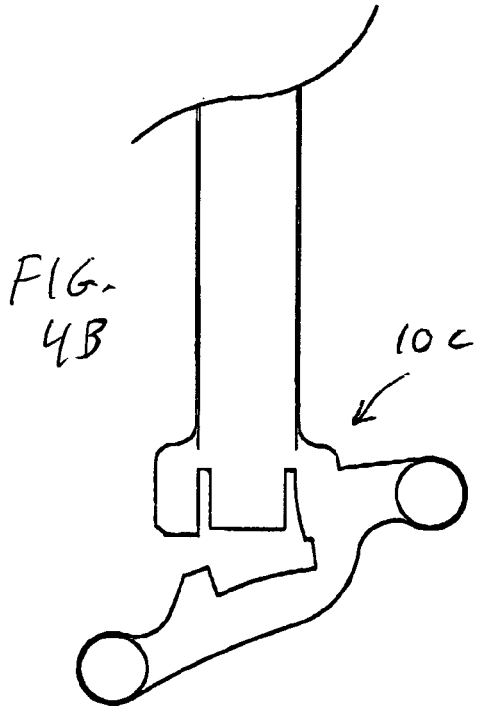
FIG. 4B
FIG. 4A
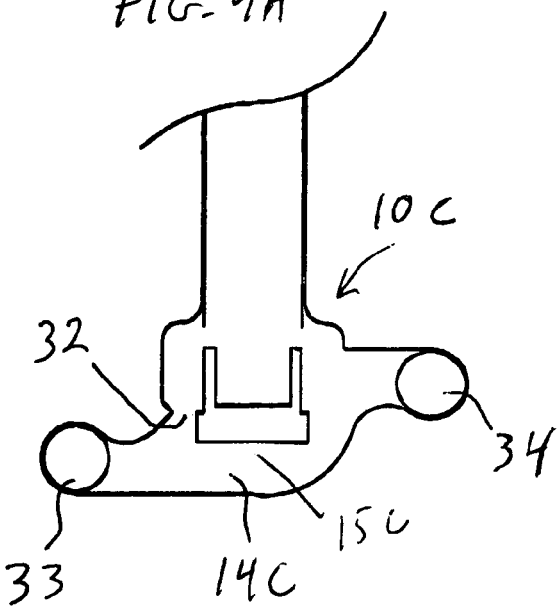

CABLE TIE

CROSS REFERENCE TO RELATED APPLICATION

This application claims priority of Provisional Application Ser. No. 60/554,108, filed on Mar. 18, 2004.

FIELD OF THE INVENTION

This invention relates to a cable tie.

BACKGROUND OF THE INVENTION

Typically, cable ties have a strap that can be engaged in a head. The head includes a pawl or another structure that locks the strap in the head. One criterion for cable quality is its tensile strength, defined as the amount of force needed to cause the cable tie to fail once it has been properly engaged around a structure. The load which a cable tie can handle is dictated by the cable tie's tensile strength.

It is sometimes desirable to remove a cable tie after it has been installed. However, as cable ties need to have a sufficient tensile strength for the task, by definition they are not designed to be easily removed. Most times, cable ties are removed by cutting the strap. This presents several problems, however. For one, an appropriate cutting tool is required. Further, the tool must be forced between the strap and the structure to which it is engaged, which can be difficult to accomplish. Also, as the straps are made of a tough material (typically a tough nylon material), they are difficult to cut.

Tearaway or breakaway cable ties have a narrowed region in the strap that can more easily be torn or broken by the user. However, this inherently weakens the strap, decreasing its tensile strength and thus its utility.

SUMMARY OF THE INVENTION

Accordingly, there is a need for a cable tie that maintains a sufficient tensile strength for the desired end use while being removable from a structure with which it is engaged without needing to be cut. It is even more desirable for such a removable cable tie to be removable without the need for a tool, and without the need to force a tool between the strap and the structure with which the strap is engaged.

This invention features in one embodiment a cable tie having an elongated tongue with two ends and two broad sides, a tip at one end of the tongue, a set of ratchet teeth extending along at least one broad side of the tongue, and a locking head at the other end of the tongue. The locking head has sides defining an opening for receiving the tip of the tongue, and a movable pawl that is hinged at one side of the opening, with another side of the locking head defining an abutment wall that is across the opening from the pawl. The pawl engages with one or more of the ratchet teeth when the tongue has been inserted through the opening with the set of ratchet teeth facing the pawl. At least one other side of the locking head defines a thinned region that can be torn by the user to release the tongue from the head.

The cable tie may further include comprising a user-graspable lever mechanically coupled to the thinned region. The lever may extend from the head substantially along and beside the tongue. The thinned region may extend along at least part of one side of the head. In one embodiment, the head has four sides that define an essentially rectangular opening, and the thinned region is along a side that is adjacent to the side that defines the abutment wall. The thinned region may extend to the outer edge of the head.

Preferably, the thinned region can be torn by manipulation of the lever. The tearing force may be in a direction transverse to the longitudinal axis of the tongue. When the head lies essentially in a plane in which at least some of the tongue also lies, and the tearing force may be transverse to the plane, and more particularly, essentially perpendicular to the plane.

The thinned region may define at least part of one side of the locking head. The thinned region may be directly adjacent to the opening. The cable tie may further include a notch in the head that defines a lever pivot region.

The cable tie may further include an extending twist portion coupled to the thinned region. The twist portion may be wider than the head. The twist portion may be along the side of the head that defines the abutment wall. The twist portion may be along a side of the head adjacent the side that defines the abutment wall.

In another embodiment the invention features a cable tie comprising an elongated tongue with two ends and two broad sides, a tip at one end of the tongue, a set of ratchet teeth extending along at least one broad side of the tongue, a locking head at the other end of the tongue, the locking head having sides defining an opening for receiving the tip of the tongue, and a movable pawl that is hinged at one side of the opening, with another side of the locking head defining an abutment wall that is across the opening from the pawl, and wherein the pawl engages with one or more of the ratchet teeth when the tongue has been inserted through the opening with the set of ratchet teeth facing the pawl, a thinned region that extends along at least a part of one side of the head, and a user-graspable lever mechanically coupled to the thinned region.

In yet another embodiment the invention features a cable tie comprising an elongated tongue with two ends and two broad sides, a tip at one end of the tongue, a set of ratchet teeth extending along at least one broad side of the tongue, a locking head at the other end of the tongue, the locking head having four sides defining a substantially rectangular opening for receiving the tip of the tongue, and a movable pawl that is hinged at one side of the opening, with another side of the locking head defining an abutment wall that is across the opening from the pawl, and wherein the pawl engages with one or more of the ratchet teeth when the tongue has been inserted through the opening with the set of ratchet teeth facing the pawl, a thinned region that extends along at least a part of a side of the head that is adjacent the side that defines the abutment wall, and a user-graspable lever mechanically coupled to the thinned region, wherein the lever extends from the head substantially along and beside the tongue.

BRIEF DESCRIPTION OF THE DRAWINGS

Other objects, features and advantages will occur to those skilled in the art from the following description of the preferred embodiments, and the accompanying drawings, in which:

FIGS. 3A through 3C are views similar to those of FIGS. 2A-2C for a third embodiment of the invention;

FIGS. 4A and 4B are top views of the head of yet another embodiment of the invention in the as-manufactured and opened states, respectively.

DETAILED DESCRIPTION OF THE PREFERRED EMBODIMENTS OF THE INVENTION

Figures 1A, 1B, 1C, 1D:
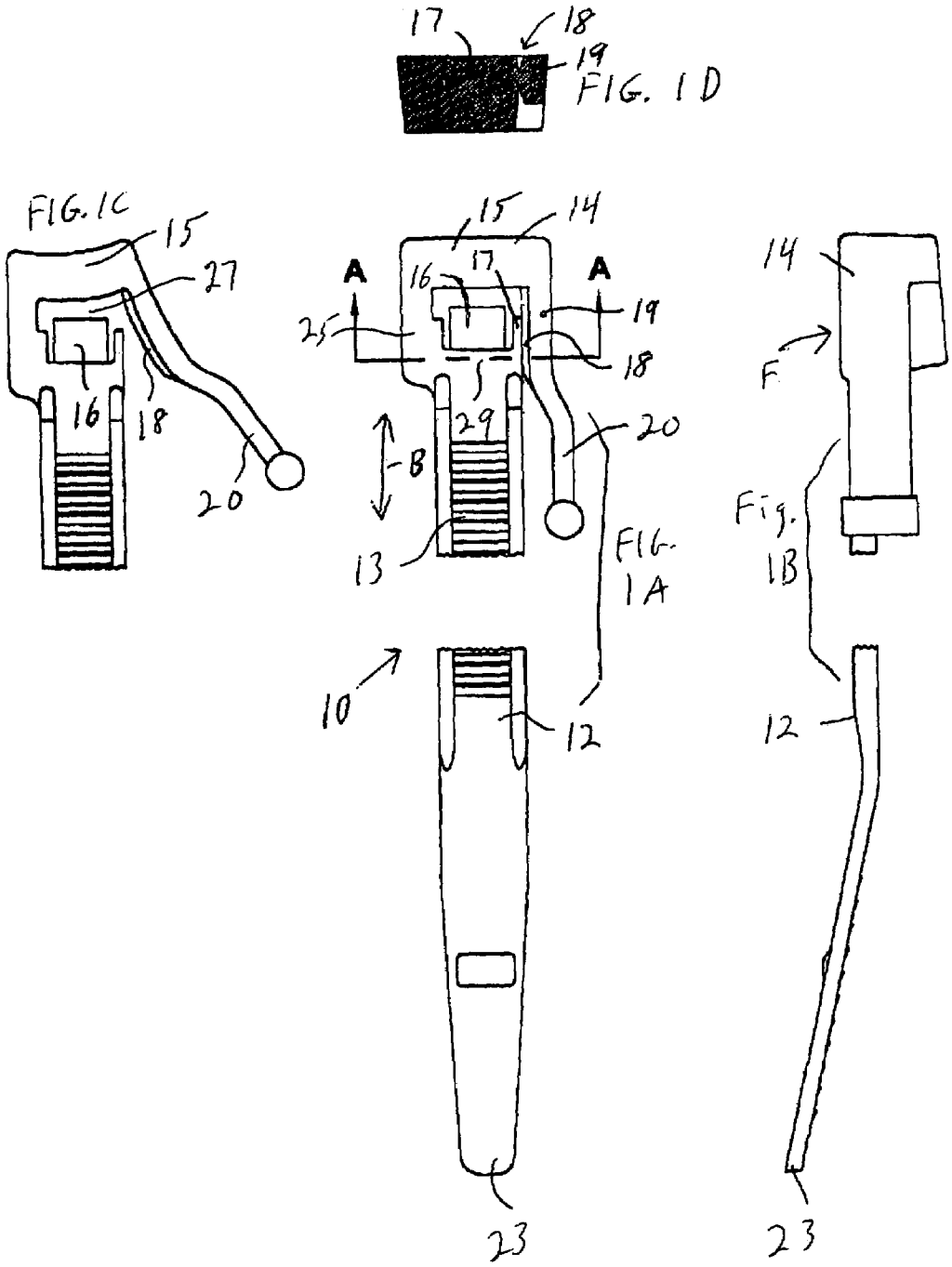
FIG. 1A is a top view of one embodiment of the cable tie of the invention.
FIG. 1B is a side view of the cable tie of FIG. 1A.
FIG. 1C is a view of the head of the cable tie of FIG. 1A with the thinned region torn to release the tongue from the head.
FIG. 1D is a cross section taken along line A-A of FIG. 1A.

The invention accomplishes a cable tie which can be removed by tearing the head portion of the cable tie. This allows the strap to maintain its proper tensile strength, while at the same time allowing the user to remove the cable tie without the need for a tool.

There is shown in FIGS. 1A-1D a preferred embodiment of cable tie 10 of the invention. Cable tie 10 has elongated strap or tongue 12 that is received in head 14 and held by pawl 16; tongue 12 has a set of ratchet teeth 13 along at least one broad side of tongue 12. Head 14 has four sides 15, 25, 29 and 17 that define essentially rectangular opening 27. Moveable pawl 16 is hinged at side 29 of opening 27. Locking head opposite sidewall 15 defines an abutment wall that is across opening 27 from pawl 16. When tongue 12 is inserted in opening 27 by pushing tip 23 up into opening 27 from below, in direction F, ratchet teeth 13 engage with pawl 16. This locks tongue 12 in head 14. All of these features are well known in the art.

Cable tie 10 is user-removable through the tear away head design depicted, in which thinned region 18 of head 14 is located between opening 16 and outer portion 19 of side 17. Lever or handle 20 is connected to portion 19, which is itself coupled to thinned region 18, to provide a means for the user to provide a sufficient force to tear region 18, which disconnects portion 19 from side 17, thus moving end side or portion 15 away from pawl 16, which releases strap 12 from head 14. Handle 20 preferably extends from the head substantially along and beside tongue 12. Region 18 preferably extends along entire side 17 to the outer edge of head 14, as shown in FIG. 1A.

The force on the cable tie when it is engaged with a structure is generally along the length of the strap and head as shown by arrow B. Thus, the thinned region 18 does not substantially affect the tensile strength of the cable tie. Handle 20 allows region 18 to be torn in a direction across the force direction B. In other words, the handle can be lifted up, thus causing a tearing force in a direction that is perpendicular to the plane in which head 14 and at least some of strap 12 lies, and thus normal to direction B.

Figure 2A:
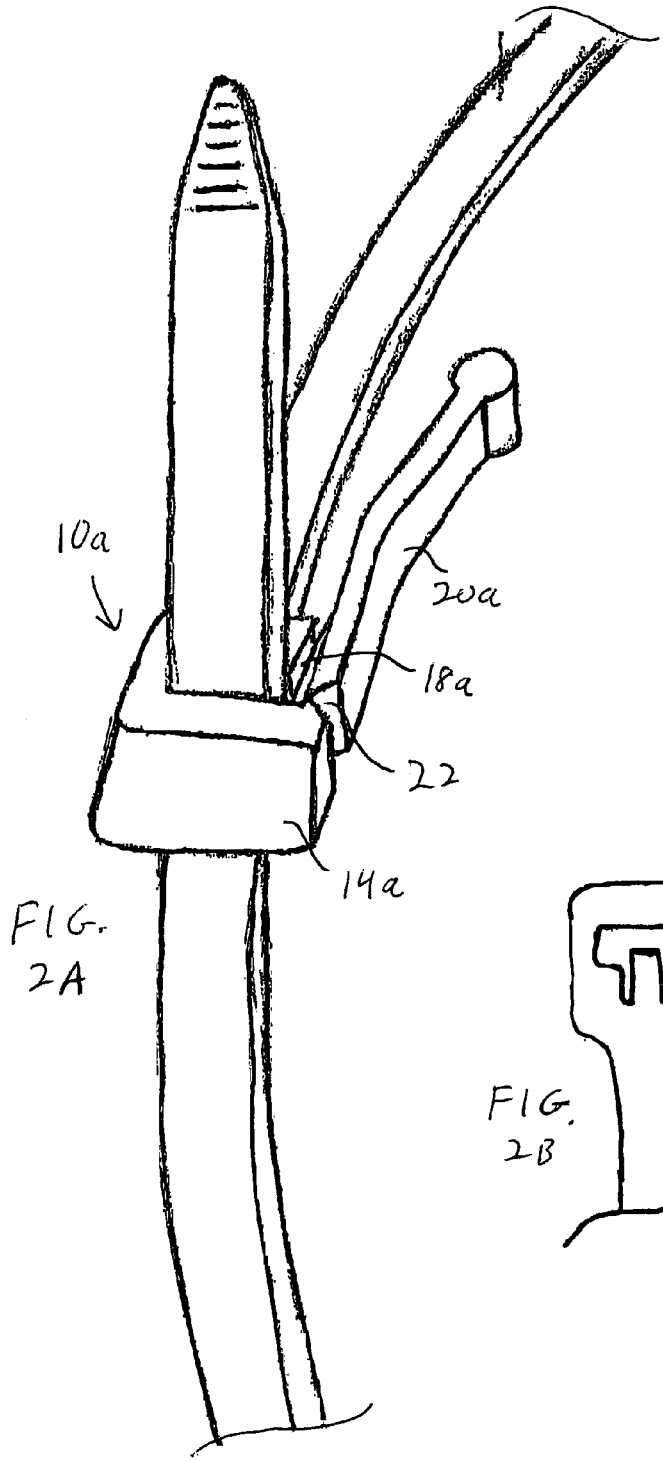
FIG. 2A is a perspective view of another embodiment of the cable tie of the invention.
Figure 2C:
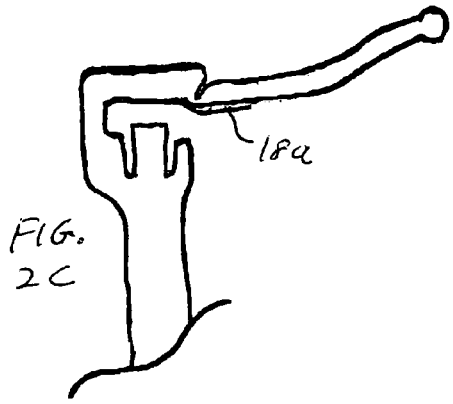
FIGS. 2B and 2C are top views of the head of the cable tie of FIG. 2A in the as-manufactured state and with the thinned region torn, respectively.
Figure 2B:
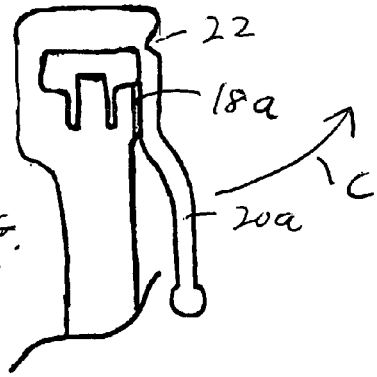

Alternative constructions for accomplishing a user-tearable head for a cable tie are shown in FIGS. 2-4. Cable tie 10*a*, FIGS. 2A-2C, also has a thinned tear portion 18*a*. Notch 22 allows handle 20*a* to be pivoted in the direction of arrow C (in the plane of the head and the handle) to tear portion 18*a* and open the head as shown in FIG. 2C.

Figures 3A, 3B:
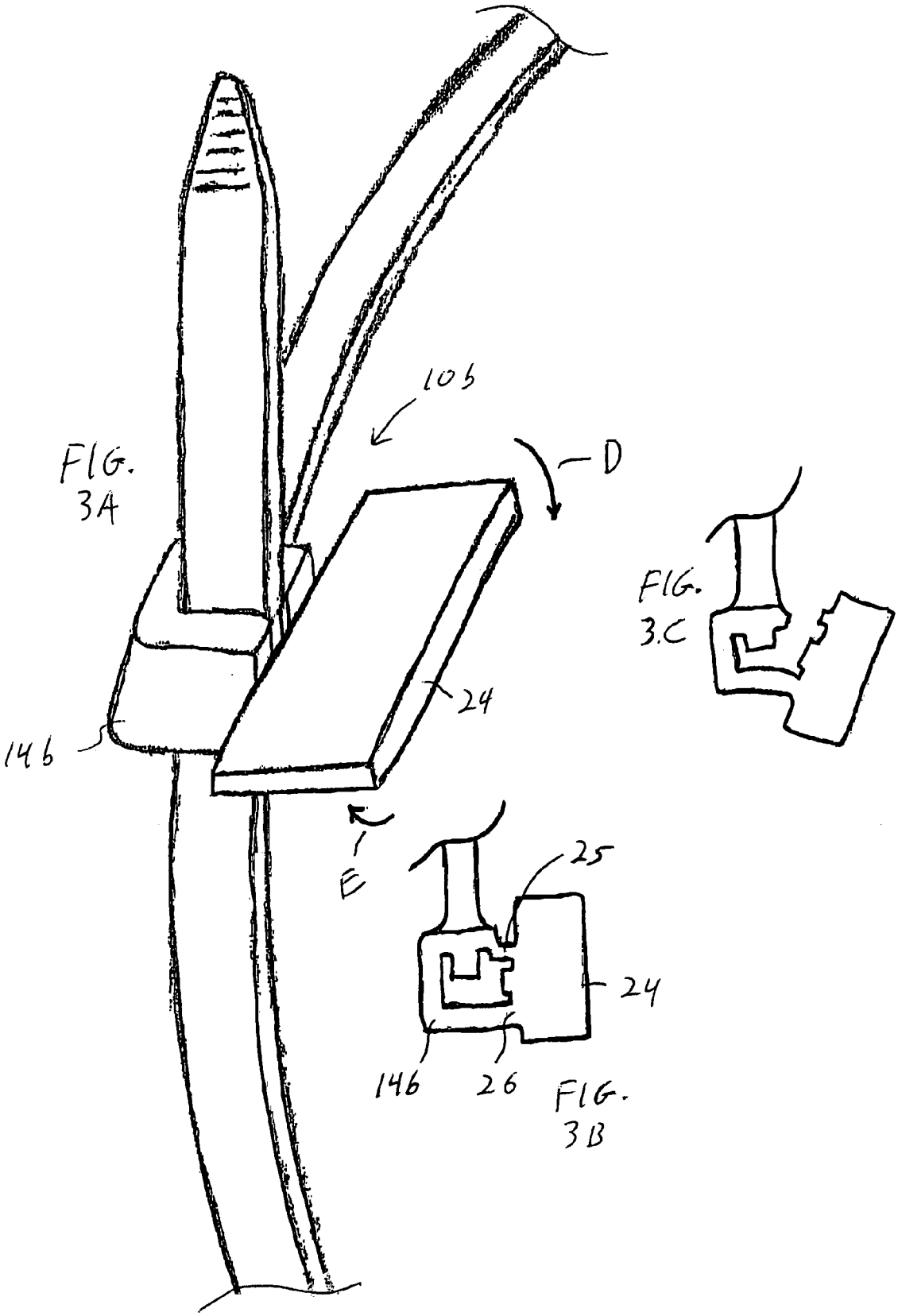

Cable tie 10*b*, FIG. 3A, has extending twist-off handle or tab 24 that is connected to head 14*b* by thinned and narrowed regions 25 and 26, FIG. 3B. When tab 24 is twisted in either direction as shown by arrows D and E, narrowed region 25 tears to open the head as shown in FIG. 3C.

Embodiment 10*c*, FIGS. 4A and 4B, has head 14*c* that includes narrowed (thinned) region 32 and extending twist portions 33 and 34 that are along the side of head 14*c* that defines abutment wall 15*c*. Portions 33 and 34 can be grasped and twisted away from the plane of the head to tear region 32 and open the head as shown in FIG. 4B.

Figure 5B:
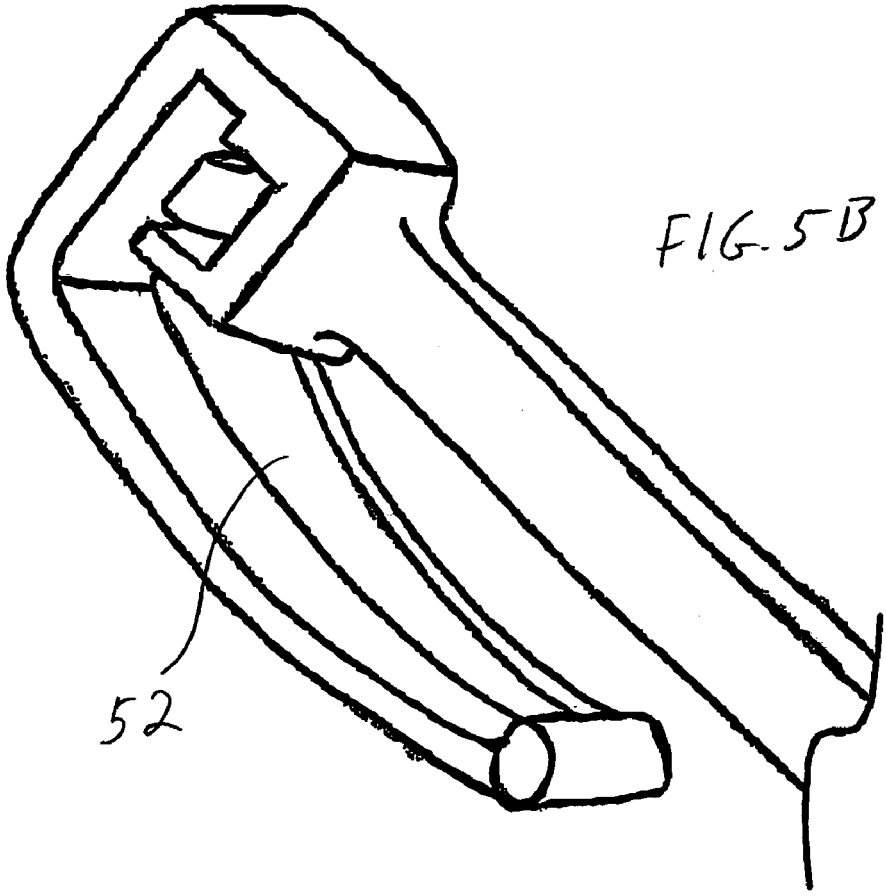
FIGS. 5A-5C are top, bottom and torn-away views of the preferred embodiment of the invention.
Figure 5A:
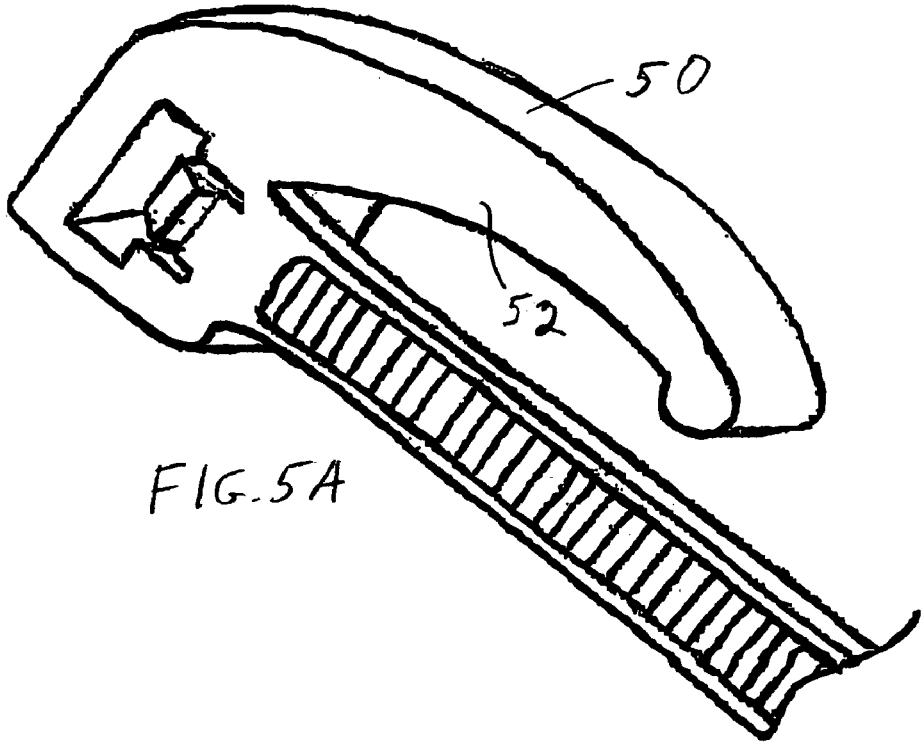
Figure 5C:
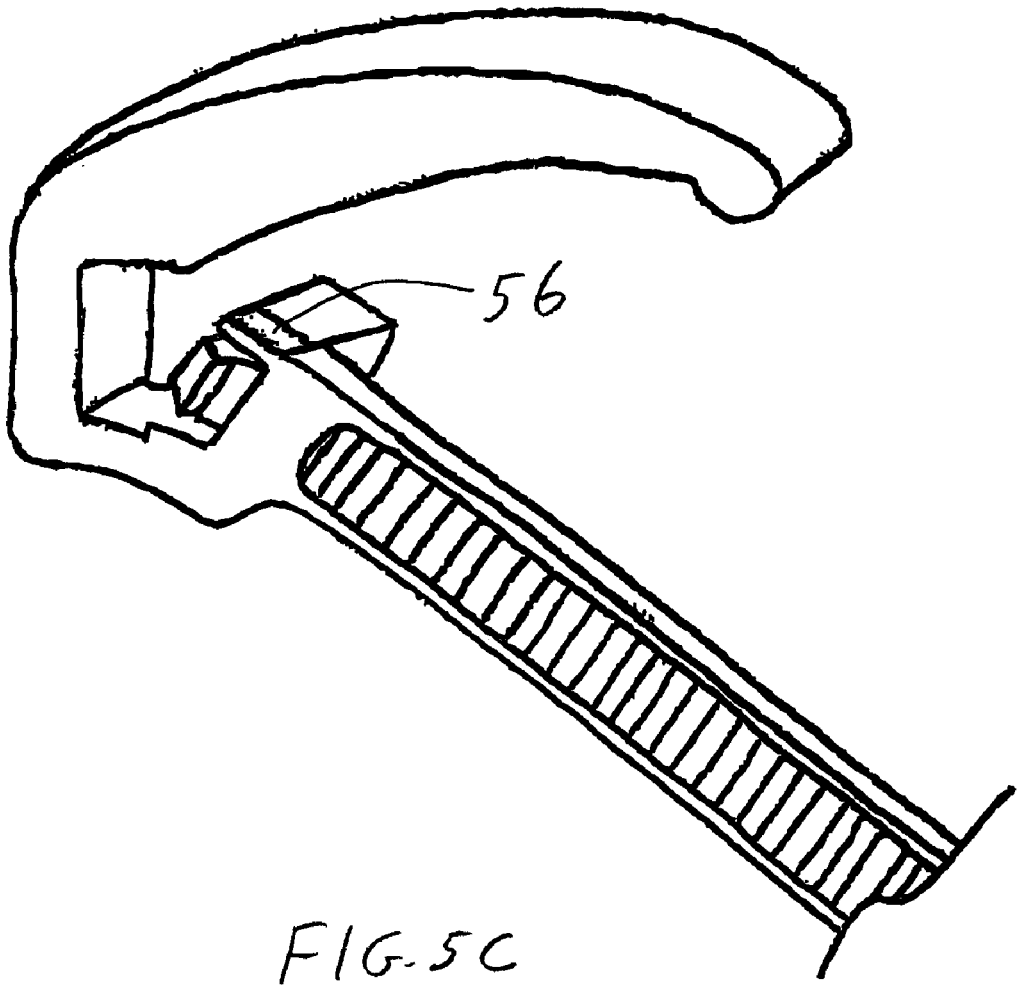

The preferred embodiment is shown in FIGS. 5A-5C. This embodiment is very similar to that of FIGS. 1A-1D, except that handle 50 has an added stiffening rib 52 to create an "L" shaped angle that strengthens the lever so that it can be used to apply the necessary head tearing force without too much bending. Tear area 56 is shown in FIG. 5C.

Other embodiments will occur to those skilled in the art and are within the following claims.

What is claimed is:

1. A cable tie, comprising:

an elongated tongue with two ends and two broad sides;

a tip at one end of the tongue;

a set of ratchet teeth extending along at least one broad side of the tongue;

a locking head at the other end of the tongue, the locking head having a plurality of sides defining an opening for receiving the tip of the tongue, and a movable pawl that is hinged at a first side of the locking head, with a second side of the locking head defining an abutment wall that is across the opening from the pawl, and wherein the pawl engages with one or more of the ratchet teeth when the tongue has been inserted through the opening with the set of ratchet teeth facing the pawl;

the locking head further defining a thinned region substantially centered along a third side of the locking head, the thinned region in non-contacting relation with the first side and the second side of the locking head; and a user-graspable lever mechanically coupled to the thinned region, wherein the thinned region can be torn by manipulation of the lever.

2. The cable tie of claim 1, wherein the thinned region can be torn by manipulation of the lever in a direction transverse to the longitudinal axis of the tongue.

3. The cable tie of claim 1, wherein the head lies essentially in a plane in which at least some of the tongue also lies, and the thinned region can be torn by manipulation of the lever in a direction transverse to the plane.

4. The cable tie of claim 3, wherein the thinned region can be torn by manipulation of the lever in a direction essentially perpendicular to the plane.

5. A cable tie, comprising:

an elongated tongue with two ends and two broad sides;

a tip at one end of the tongue;

a set of ratchet teeth extending along at least one broad side of the tongue;

a locking head at the other end of the tongue, the locking head having four sides defining a substantially rectangular opening for receiving the tip of the tongue, and a movable pawl that is hinged at a first side of the locking head, with a second side of the locking head defining an abutment wall that is across the opening from the pawl, and wherein the pawl engages with one or more of the ratchet teeth when the tongue has been inserted through the opening with the set of ratchet teeth facing the pawl;

a thinned region substantially centered along a third side of the locking head, the thinned region in non-contacting relation with the first side and the second side of the locking head; and a user-graspable lever mechanically coupled to the thinned region, wherein the lever extends from the head substantially along and beside the tongue and the thinned region can be torn by manipulation of the lever.

6. A cable tie, comprising:

an elongated tongue with two ends and two broad sides;

a tip at one end of the tongue;

a set of ratchet teeth extending along at least one broad side of the tongue;

a locking head at the other end of the tongue, the locking head having four sides defining a substantially rectangular opening for receiving the tip of the tongue, and a movable pawl that is hinged at a first side of the locking head, with a second side of the locking head defining an abutment wall that is across the opening from the pawl, and wherein the pawl engages with one or more of the ratchet teeth when the tongue has been inserted through the opening with the set of ratchet teeth facing the pawl;

a thinned region substantially centered along a third side of the locking head, the thinned region in non-contacting relation with the first side and the second side of the locking head;

a user-graspable lever mechanically coupled to the thinned region, wherein the lever extends from the head substantially along and beside the tongue and the thinned region can be torn by manipulation of the lever in a direction transverse to the longitudinal axis of the tongue.

* * * * *